US011497242B2

(12) United States Patent
Grimm et al.

(10) Patent No.: US 11,497,242 B2
(45) Date of Patent: Nov. 15, 2022

(54) ACCESSORY E-CIGARETTE AND FILTER ASSEMBLY

(71) Applicants: John Grimm, Encinitas, CA (US); Yuval Shenkal, Encinitas, CA (US)

(72) Inventors: John Grimm, Santee, CA (US); Yuval Shenkal, Cardiff by the Sea, CA (US)

(73) Assignee: Philter Labs Incorporated, Encinitas, CA (US)

( * ) Notice: Subject to any disclaimer, the term of this patent is extended or adjusted under 35 U.S.C. 154(b) by 95 days.

(21) Appl. No.: 17/171,986

(22) Filed: Feb. 9, 2021

(65) Prior Publication Data

US 2021/0161205 A1 Jun. 3, 2021

Related U.S. Application Data

(63) Continuation-in-part of application No. 16/697,676, filed on Nov. 27, 2019, now abandoned.

(60) Provisional application No. 62/774,276, filed on Dec. 2, 2018.

(51) Int. Cl.
*A24F 13/00* (2006.01)
*A24F 40/40* (2020.01)

(52) U.S. Cl.
CPC ..... *A24F 13/00* (2013.01); *A24F 40/40* (2020.01)

(58) Field of Classification Search
None
See application file for complete search history.

(56) References Cited

U.S. PATENT DOCUMENTS

| | | | | |
|---|---|---|---|---|
| 4,993,435 | A * | 2/1991 | McCann | A24F 13/00 131/175 |
| 5,188,450 | A | 2/1993 | Anderson | |
| 5,752,527 | A * | 5/1998 | Bowen et al. | A24F 13/00 131/175 |
| 9,433,242 | B1 | 9/2016 | Buffone | |
| 2004/0136185 | A1 | 7/2004 | Sharrah | |
| 2009/0056728 | A1 * | 3/2009 | Baker | A24F 13/00 131/191 |
| 2015/0250250 | A1 | 9/2015 | Cross | |
| 2017/0119044 | A1 | 5/2017 | Oligschlaeger et al. | |
| 2017/0224095 | A1 | 8/2017 | Redfern | |
| 2018/0132533 | A1 | 5/2018 | Chen | |
| 2020/0060339 | A1 | 2/2020 | Di Bari | |

* cited by examiner

*Primary Examiner* — Dionne W. Mayes
(74) *Attorney, Agent, or Firm* — Timothy W. Fitzwilliam

(57) ABSTRACT

An accessory e-cigarette and filter assembly that is essentially a holder for both a vaporizer/e-cigarette and an exhale filter is disclosed. The device also allows for removably pairing an exhale filter to a vaporizer and provides impact protection thereto. In the preferred embodiment, a sleeve with parallel channels provides for the filter and e-cigarette to be juxtaposed however a mouthpiece for the filter and a mouthpiece for the e-cigarette are at opposite ends.

9 Claims, 8 Drawing Sheets

ACCESSORY E-CIGARETTE AND FILTER ASSEMBLY

PRIORITY CLAIM

This patent application claims benefit of the priority date of U.S. patent application Ser. No. 16/697,676 filed on Nov. 27, 2019 entitled "Accessory E-Cigarette And Filter Sleeve Assembly;" which in turn, claims benefit of the priority date of U.S. Prov. Pat. App. Ser. No. 62/774,276 filed on Dec. 2, 2018 entitled "Accessory E-Cigarette Filter Assembly." Accordingly, the entire contents these U.S. patent submissions are hereby expressly incorporated by reference.

BACKGROUND OF THE INVENTION

Field of the Invention

The present invention pertains generally to accessories for electronic smoking devices. More specifically, the present invention relates to a sleeve for receiving an exhale filter further accommodating and coupling to a vaporizer or e-cigarette, the filter for cleansing and scrubbing exhaled vapor.

Description of the Prior Art

Ever increasing in popularity, "electronic cigarettes/e-cigarettes" and vaporizers typically use an electrical heating element to heat a liquid usually containing a mixture of nicotine and flavorings/extract that produces a mist similar to smoke but without the excessive heat that causes combustion. A useful exemplary apparatus was proposed by Counts et al., U.S. Pat. No. 5,666,978, entitled "Electrical Smoking System for Delivering Flavors and Methods of Making Same," and was awarded patent protection in 1997. This particular prior art device has a receptacle for receiving tobacco or "tobacco flavored material" and electrical heating elements configured to the device for heating the material in order to emit vapors or aerosol for delivery to a smoker.

Over the intervening years, e-cigarettes have evolved to pen types, stick or wafer types, or larger units fitting into a user's hand with a mouthpiece coupled thereto.

Further, as e-cigarette use has expanded and gained momentum, either as an alternative to typical cigarettes or smoked flower material, so have accessory items to accompany them. One such accessory currently on the market has been branded the Smoke Buddy®. This device is specifically an external filter for receiving exhaled mist; however, it's bulky, awkward and irregular in shape. Other e-cigarette accessories on the market include holders, containers, cases, and outer protectors such as typical for smart phones. Accordingly, the present invention herein is somewhat of a combination of these accessories further providing a novel and useful mating of a commercial vaporizer or e-cigarette with an original and unique filter.

BRIEF SUMMARY OF THE INVENTION

The present invention specifically addresses and alleviates the above mentioned deficiencies, more specifically, the present invention, in a first aspect is an accessory e-cigarette and filter assembly comprising: an electronic cigarette (or vaporizer) to be mated to an exhale filter; a first longitudinal axis positioned lengthwise along the accessory e-cigarette and filter assembly a first aperture centered about the first longitudinal axis for receiving and holding the electronic cigarette at an upper portion thereof; a second aperture centered about the first longitudinal axis for receiving and holding the electronic cigarette at a lower portion thereof; a third aperture centered about a second longitudinal axis positioned lengthwise along the accessory e-cigarette and filter assembly, the second longitudinal axis positioned parallel to the first longitudinal axis, the third aperture for receiving and holding the exhale filter at an upper portion thereof; and a fourth aperture centered about the second longitudinal axis for receiving and holding the exhale filter at a lower portion thereof, the electronic cigarette thereby mated and secured juxtaposed to the exhale filter. Or alternatively, the exhale filter has and exit vent at a bottom portion thereof, configured similarly sized with the fourth aperture and wherein the bottom portion of exhale filter rests upon a bottom end wall, the bottom end wall having the fourth aperture therethrough. It should be appreciated the exhale filter has a mouthpiece and also electronic cigarette has a mouthpiece, and these could be situated at opposite end or at the same end.

In still a second aspect, the invention is an accessory sleeve for a vaporizer comprising: a first lengthwise channel in parallel to a longitudinal axis of the sleeve for receiving the vaporizer; and a second lengthwise channel parallel to the first lengthwise channel for receiving a filter device, wherein the first and second channels are configured to friction fit said vaporizer and said filter device.

The invention in this aspect is additionally characterized in that it comprises a top end wall and a bottom end wall opposite the top end wall. Also, the first lengthwise channel further comprises a race track configuration through the top end wall and the bottom end wall, the race track configuration being a rectangle with rounded ends.

Additionally further, the race track configuration is defined as having a rounded carve out in each of two opposing sides to accommodate a curved surface on the vaporizer. Also further an interior wall separates the first and second lengthwise channels.

Still further in this aspect the invention may be characterized wherein both of the first and second lengthwise channels each comprise a cut out exposing an interior of the sleeve, the cut out for assisting a user in receiving and removing the vaporizer and the filter to and from the sleeve. Also in the preferred embodiment, the sleeve is made from soft silicon rubber for providing impact protection to the vaporizer and the filter and facilitating the friction fit.

Yet further notably the filter device comprises a mouthpiece, and further wherein the filter device mouthpiece rests upon a top end wall of the accessory sleeve also within the first lengthwise channel. In other words, the top end wall is an abutment to the filter device mouthpiece. Also in this aspect, the invention may be characterized in that the top end wall and bottom end wall each comprise apertures appropriately sized and shaped to allow for the filter and vaporizer to be secured with mouthpieces at opposite ends of the accessory sleeve.

In another aspect the invention may be characterized as an accessory sleeve for an exhale filter comprising a first lengthwise channel concentric to a longitudinal axis of the sleeve for receiving the exhale filter wherein the exhale filter includes a mouthpiece wherein the mouthpiece rests upon a top surface of the first lengthwise channel. Uniquely included to this particular embodiment, an eyelet is coupled to the sleeve at an end thereof, for connecting to a lanyard, or a key chain, or a clip as preferred by a user.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF PREFERRED EMBODIMENTS

Figure 1A:
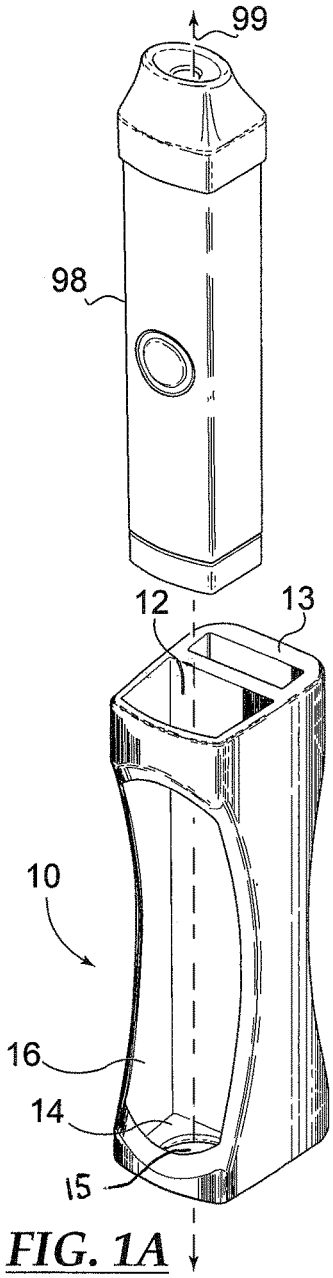
FIG. 1A is a first exploded view of an accessory dual sleeve mating a filter device to an e-cigarette of the present invention.

Referring initially to FIG. 1A, an exploded view of a filter device 98 to be mated to an e-cigarette 87, 88 via a first preferred accessory sleeve 10 is shown. The accessory sleeve 10 is designed to integrate a Philter™ Solo/Pocket device 98 with existing off the shelf commercial vaporizer pens 88 (FIG. 1B, FIG. 1C), sticks 87 (FIG. 1D, FIG. 1E), and dry herb vaporizers.

Also referring to FIG. 1A through FIG. 1E, the adapter sleeve 10 will receive the personal exhale filtering device 98 on one side and the commercial vaporizer pen 88 or stick 87 on the other side in opposing directions. That is, a mouthpiece for the vaporizer 87, 88 will protrude from one end 14 while a mouthpiece 94 for the filter 98 will protrude from the opposite end 13. The user will operate the vaporizing device as normal, and then flip the device about its axis 89, 99 and exhale into the filter device 98. This adapter sleeve 10 is preferably made from a compliant material such as silicone or other flexible polymer that can accommodate various sizes and geometries of commercial vaporizers. Specifically, the material will be slightly pliable to allow for a friction fit for either a pen or a stick having sizes that may vary slightly. Furthermore, the sleeve 10 material will provide impact resistance to the pen 88, stick 87 and filter 98 affording protection thereto. With regard to FIG. 1C, a cylindrical pen 88 easily fits within a rectilinear aperture 11 due to the pliable silicone material having elastic properties.

An important aspect of the invention is the end view aspect FIG. 1F, FIG. 1G, FIG. 2F and FIG. 2G, of the sleeve that receives either the pen 88 or the stick 87. Initially, the end view of the sleeve comprises a racetrack configuration for the first aperture 11, 21, forming a first lengthwise channel, that is essentially a rectangle with rounded corners 19; or the racetrack configuration could be a rectangle with rounded ends 18.

Figure 1C:
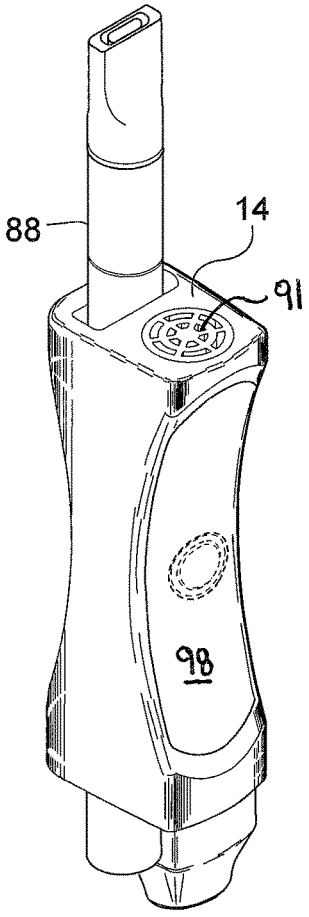
FIG. 1C is an isometric view of the sleeve of the present invention having received a pen-type e-cigarette, the view from an opposite underneath vantage point.
Figure 1E:
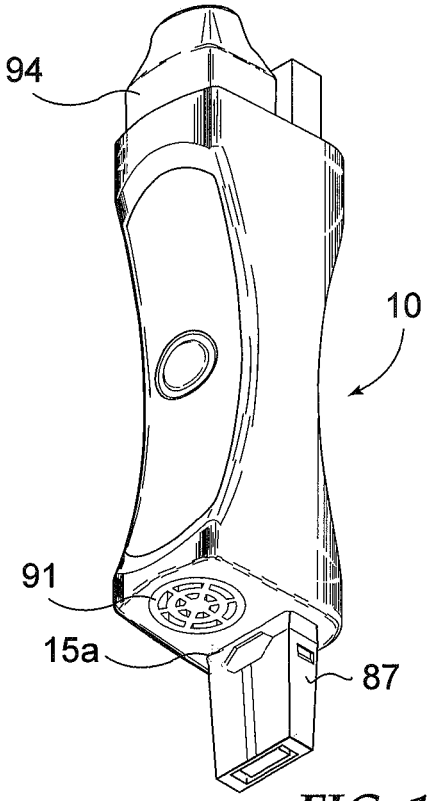
FIG. 1E is an isometric view of the sleeve of the present invention having received a stick-type e-cigarette.
Figure 1F:
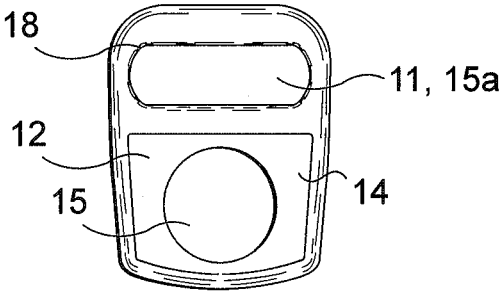
FIG. 1F is a top plan view of the sleeve particularly showing apertures for $1^{st}$ and $2^{nd}$ lengthwise channels.
Figure 1G:
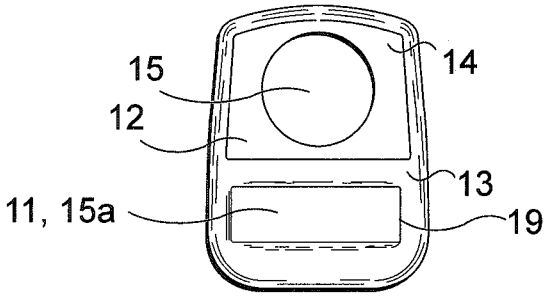
FIG. 1G is a top plan view alternative embodiment to the $1^{st}$ lengthwise channel.
Figure 2B:
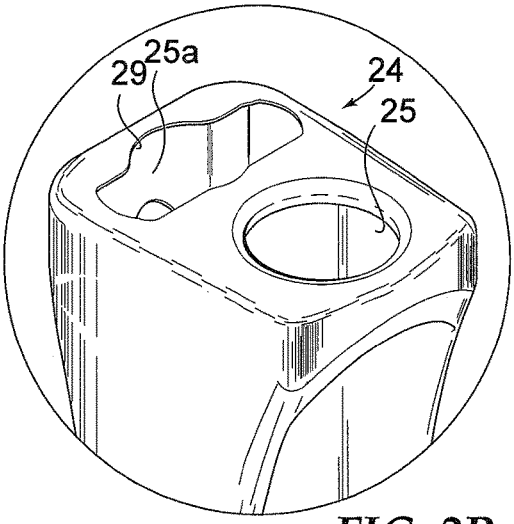
FIG. 2B is an enlarged view thereof taken about line 2B-2B in FIG. 2A.
Figure 2A:
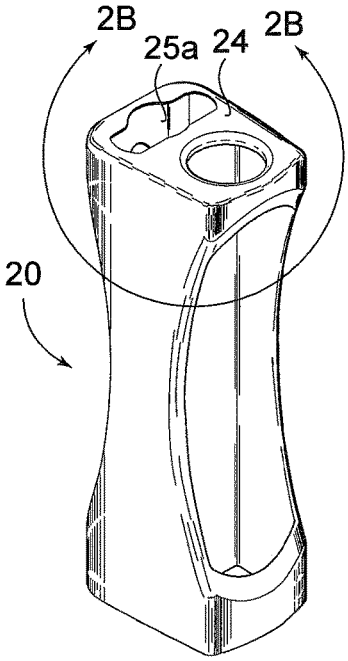
FIG. 2A is an isometric view of an improved version of the sleeve with a more specific geometry in the top plan view.
Figure 2C:
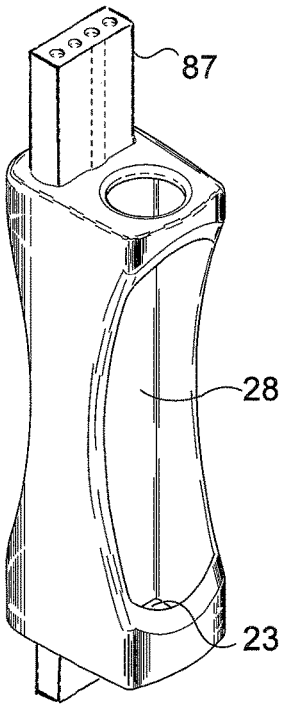
FIG. 2C is an isometric view of the $2^{nd}$ generation sleeve having received a stick-type e-cigarette or vaporizer.
Figure 2D:
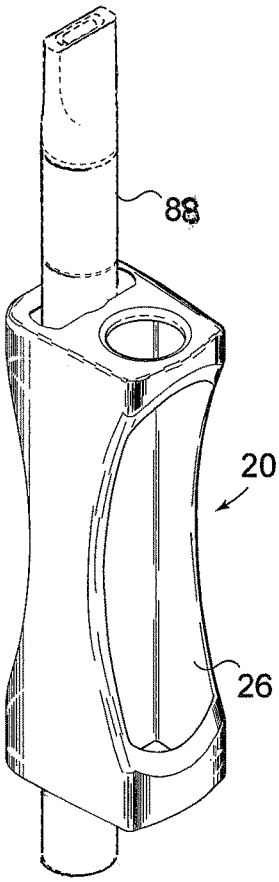
FIG. 2D is an isometric view of the $2^{nd}$ generation sleeve of the present invention having received a pen-type e-cigarette.

An improvement to the rectangular end view with rounded ends is illustrated in FIG. 2A and FIG. 2B. Herein, the racetrack configuration has a pair of curved carve outs 29 in the two opposing sides to accommodate a curved surface of the cylindrically shaped vaporizer pen 88. Importantly, regarding the present invention, the same sleeve 10, 20 can hold a cylindrical pen 88 or rectilinear stick 87 providing versatility. In addition it should be noted, for example in FIG. 1A and FIG. 1C, that the size of the apertures ($1^{st}$ and $2^{nd}$) 11, 12 in the top end wall 13 corresponding to first channel 11 and second channel 12, together with apertures 15, 15*a* ($3^{rd}$ and $4^{th}$) a in bottom end wall 14 (FIG. 1C) allow for the filter 98 and vaporizer 87, 88 to be secured with the vaporizer mouthpiece and the filter mouthpiece 94 at opposite ends of the accessory sleeve. More specifically, large aperture 12, 22 forming the second lengthwise channel 12, 22 in top end wall 13, 23 is larger to accommodate the body of the filter 98 and smaller aperture 15, 25 for the second lengthwise 12, 22 channel in the bottom end wall 14, 24 acts as a stop for the filter only exposing the exhale vent 91 clearly illustrated in FIG. 1C and FIG. 1E. And, the stick 87 or the pen 88 may be inserted in either lengthwise 89 direction. Herein, apertures 11, 12, 15, 15*a*, 21, 22, 25, 25*a* that secure the vaporizer 87, 88 and filter 98 may be termed first, 11, 21, second, 15*a*, 25*a*, third, 12, 22 and fourth 15, 25 apertures, wherein first, 11, 21, and second, 15*a*, 25*a*, are about first axis 89 and third, 12, 22 and fourth 15, 25 apertures are about second axis 99, parallel to the first 89.

Also notably, first 11 and second 12 channels have end walls 13, 14, 23, 24 formed by the top surface 13, 23 and the bottom surface 14, 24. Further with regard to FIG. 2F and FIG. 2G, apertures in the end walls 13, 14, 23, 24 provide a beginning and an end of the first and second channels 11, 12, 21, 22. The apertures 11, 12 for the first lengthwise channel 11, 21 have an identical shape, either racetrack 18 or modified racetrack 19, 29. With regard to FIG. 2G, the apertures that accommodate the filter are either shaped like the filter 98 body, as in the top end wall 13, 23; or circular in shape to accommodate a filter exit vent 91 in the bottom end wall 14, 24. The exit vent 91 is clearly shown on FIG. 1C and FIG. 1E on the bottom surface 14 end wall 14. And comparing FIG. 1E with FIG. 1F, the fourth aperture 15 about axis 99 has substantially the same diameter as exit vent 91 for accommodating same.

Figure 1B:
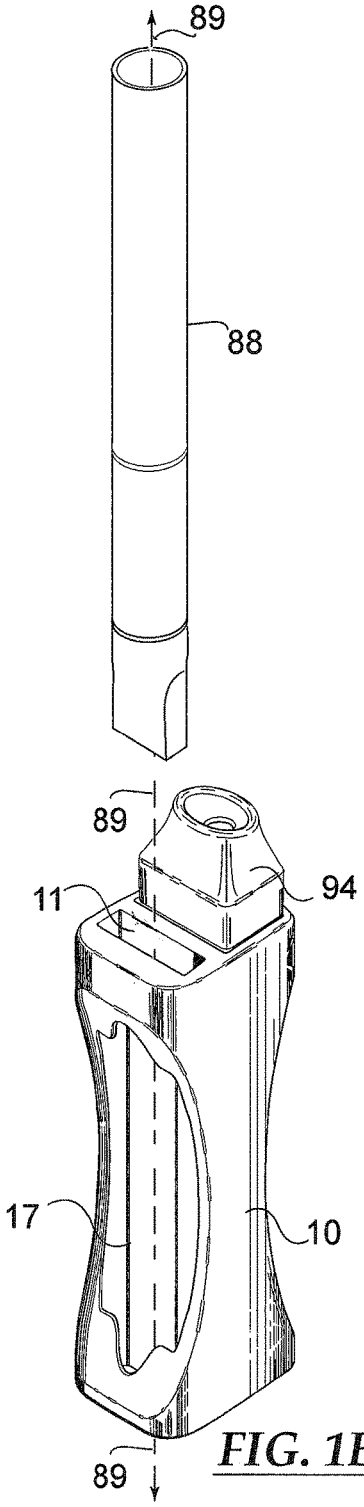
FIG. 1B is a second exploded view of the sleeve prepared to receive a pen-type vaporizer.
Figure 1D:
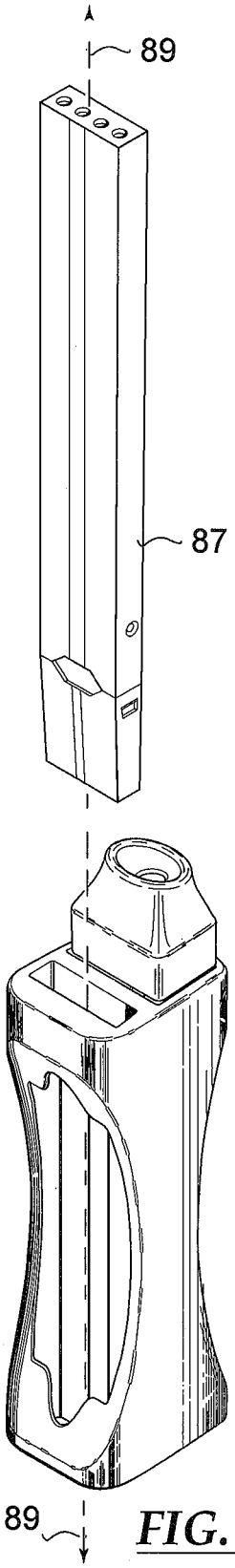
FIG. 1D is an additional exploded view of the sleeve prepared to receive a stick-type vaporizer.

Particularly with regard to FIG. 1B, it should be understood that in some embodiments, the filter device 98 may be separate and distinct from the present invention 10, 20, 30, 40; and in other embodiments, the filter device mouthpiece 94 is included because of its interrelatedness with the sleeve 10, 20, 30, 40; specifically in that the mouthpiece 94 rests upon an outside of top surface end wall 13, 23 when the filter device is inserted down into second lengthwise channel 12, 22. Embodiments 30, 40 illustrated in FIG. 3D and FIG. 4B also show this arrangement. Due to the interrelatedness in some embodiments, the filter mouthpiece 94 is shown dashed lines in some illustration and in others, it 94 is not shown in dashed lines.

Figure 2E:
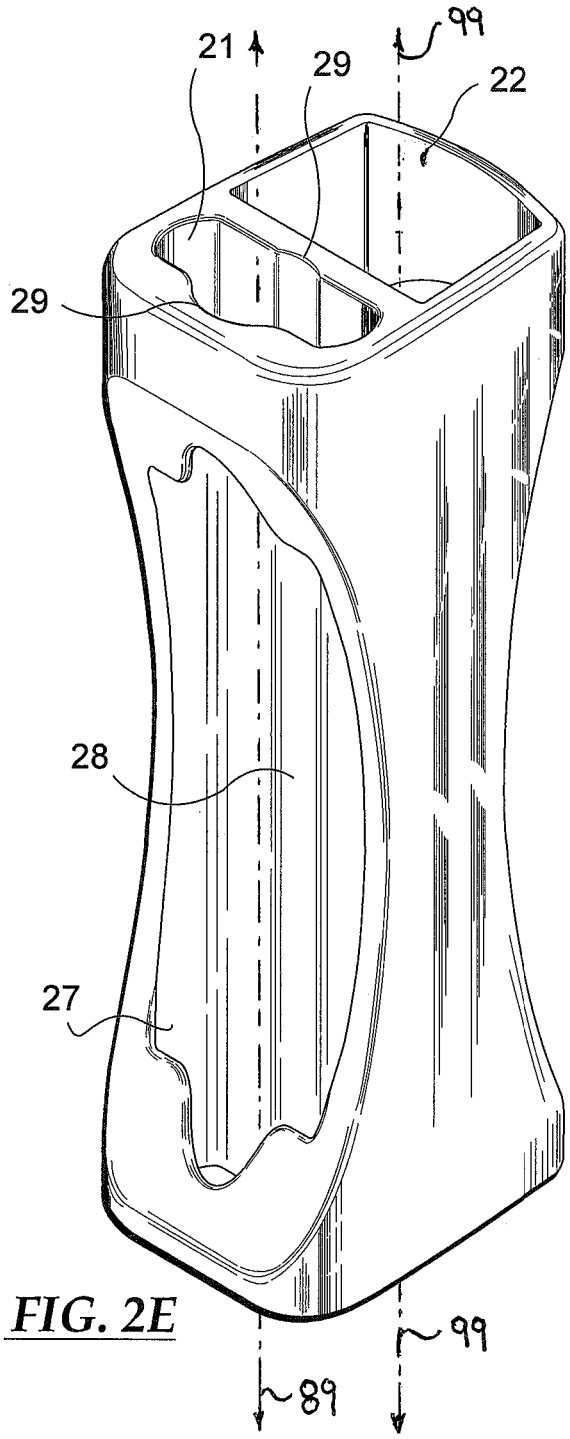
FIG. 2E is an isometric view thereof from a rear vantage point.
Figure 2F:
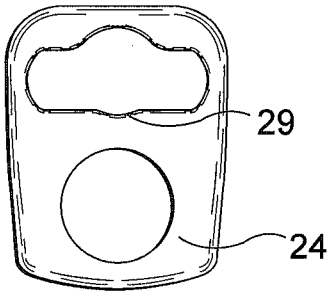
FIG. 2F is a bottom plan view particularly showing the $1^{st}$ lengthwise channel having a pair of rounded carve outs for accommodating a pen-type device.
Figure 2G:
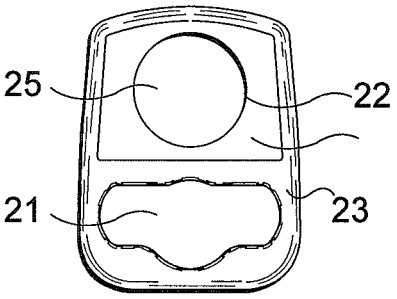
FIG. 2G is a top plan view thereof.

Also with regard to FIG. 1C, FIG. 2A, and FIG. 2E, the channels 11, 12, 21, 22 have carve outs 16, 17, 26, 27 or reliefs in the side exposing the pen 88 or stick 87 and the filter 98, These reliefs 16, 17, 26, 27 are useful to work either the pen, stick or filter out of sleeve 10, 20 by a user's thumb or finger. Additionally, the first 11, 21 and second 12, 22 channels are separated by a wall 28 at an interior to the sleeve 10, 20. In the case of the second generation embodiment and as shown in FIG. 2A, the rounded cut outs 29 to the racetrack configuration 18 extend all the way down on that side of the wall 28 in the first channel.

FIG. 3A through FIG. 3D are illustrative of an additional sleeve embodiment 30 containing magnets. In this concept variation, an adapter sleeve 30 will house the personal exhale filter device 98 on one side 37 and have a magnetic receiver 39 the other 38 that will allow the user to attach via the magnetic connection. This allows the accessory sleeve to fit various diameter and larger geometric shaped vaporizers 95 and electronic cigarettes, since the accessory filter assembly 30 would not have to fit entirely over the vaporizer 95 as in other embodiments. The sleeve 30 further includes a curved surface 38 opposite a side 37 that holds the filter 98.

A slight variation contemplated herein has the attachment mechanism as in FIG. 3A through FIG. 3D comprising magnets 39, but instead of flipping the device around to exhale into it, the variation slides up using a slider button (or translational lever) and subsequently retracts. In this manner, the filter mouthpiece 94 is extended for exhale by a user and conveniently slides back when not in use.

Figure 4A:
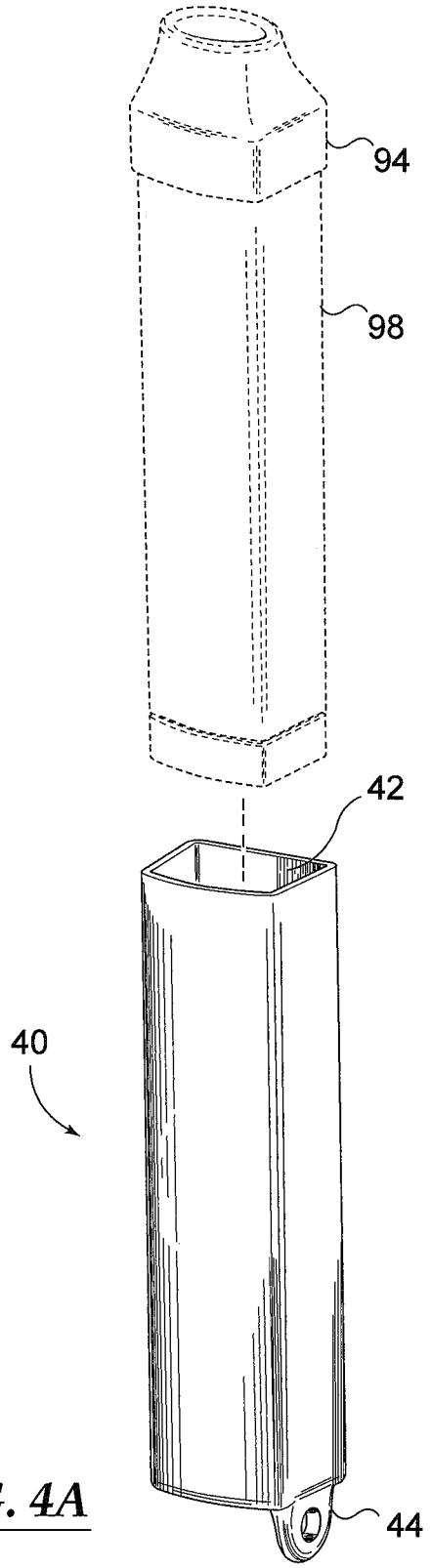
FIG. 4A is an exploded view of an eyelet sleeve embodiment to receive a only the personal exhale filter.
Figure 4B:
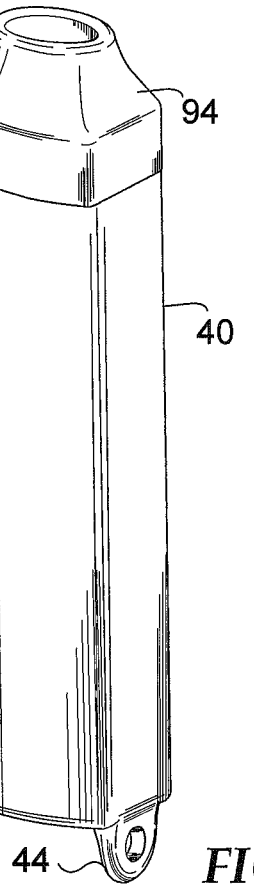
FIG. 4B is an isometric view of the additional eyelet sleeve embodiment.
Figure 4C:
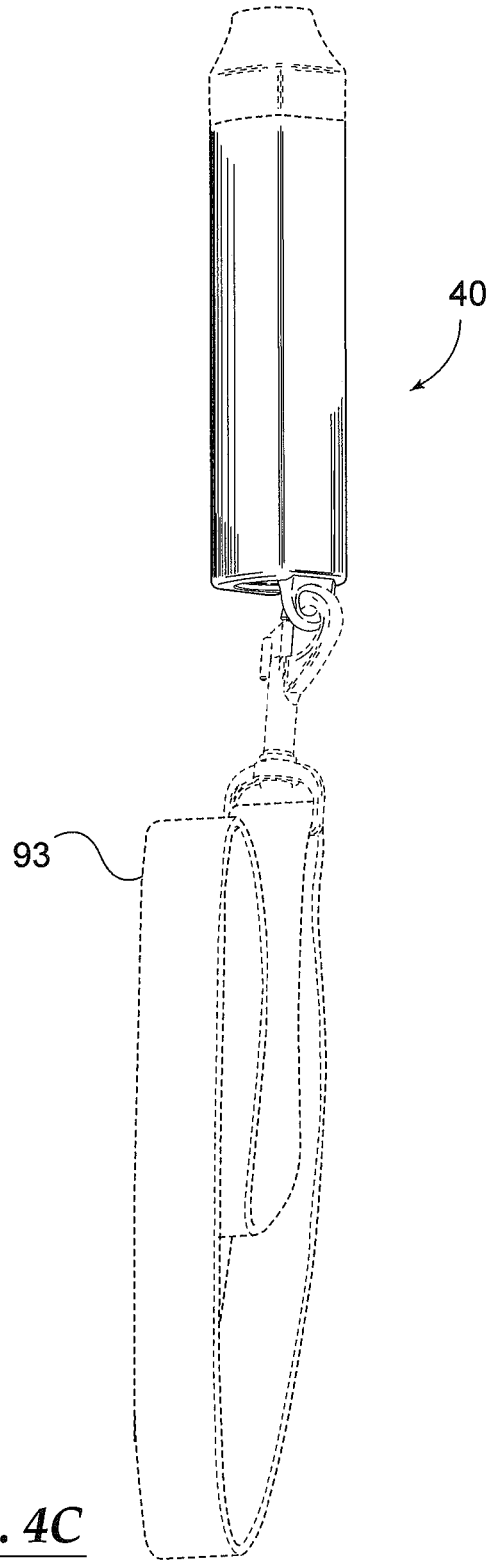
FIG. 4C is a perspective view of the eyelet sleeve embodiment coupled to a lanyard intended use.

FIG. 4A through FIG. 4C illustrate an additional sleeve embodiment 40 particularly for receiving a filter 98 (or possibly a vaporizer 85, 87, 88) via a channel 42. The sleeve 40 incorporates an eyelet 44 at an end thereof for connecting to a clip, a keychain and/or a lanyard 93, as shown in FIG. 4C.

As detailed herein (FIG. 1A through FIG. 2G), the invention in one aspect is an accessory e-cigarette and filter assembly 10, 20 comprising: an electronic cigarette 88 (or vaporizer 87) to be mated to an exhale filter 98; a first longitudinal axis 89 positioned lengthwise along the accessory e-cigarette and filter assembly 10, 20; a first aperture 11, 21 centered about the first longitudinal axis 89 for receiving and holding the electronic cigarette 88 at an upper portion thereof; a second aperture 15*a*, 25*a* centered about the first longitudinal axis 89 for receiving and holding the electronic cigarette at a lower portion thereof; a third aperture 12, 22 centered about a second longitudinal axis 99 positioned lengthwise along the accessory e-cigarette and filter assembly, the second longitudinal axis 99 positioned parallel to the first longitudinal axis 89, the third aperture 12, 22 for receiving and holding the exhale filter 98 at an upper portion thereof; and a fourth aperture 15, 25 centered about the second longitudinal axis 99 for receiving and holding the exhale filter at a lower portion thereof, the electronic cigarette 88 thereby mated and secured juxtaposed to the exhale filter 98. Or alternatively, the exhale filter 98 has and exit vent 91 at a bottom portion thereof, configured similarly sized with the fourth aperture 15, 25 and wherein the bottom portion of exhale filter rests upon a bottom end wall 14, the bottom end wall having the fourth aperture 15, 25 therethrough. It should be appreciated the exhale filter 98 has a mouthpiece 94 and also electronic cigarette 88 has a mouthpiece, and these could be situated at opposite end or at the same end.

Also as detailed herein (FIG. 1A through FIG. 2G), the invention in another aspect is accessory sleeve 10, 20 for a vaporizer 87, 88 comprising: a first lengthwise channel 11, 21, the first channel also being defined by a first lengthwise axis 89. Additionally, the accessory sleeve has a second lengthwise channel 12, 22 also defined by axis 99, parallel or juxtaposed to the first lengthwise channel for receiving an exhale filter device 98, wherein the first and second channels are configured to friction fit both the vaporizer and the exhale filter device.

The invention in this aspect is additionally characterized in that the first lengthwise channel further comprises a race track 18 configuration in an end view. Further, the race track configuration comprises a rectangle with rounded ends. Alternatively, the end view racetrack has rounded corners 19 without rounded ends. An improvement to the racetrack end view, comprises a curved carve out 29 in each of two opposing sides to accommodate a curved surface on a pen-type 88 vaporizer.

Figure 3A:
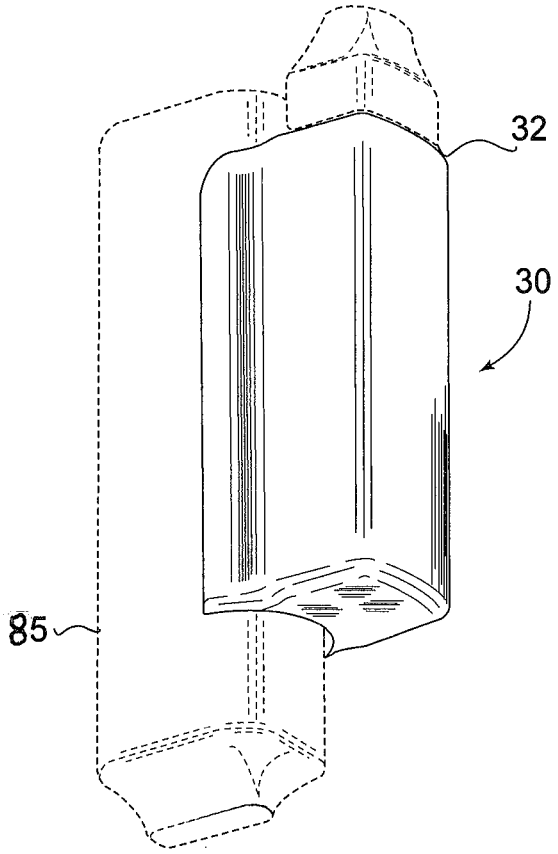
FIG. 3A is an isometric view of an additional sleeve embodiment containing magnets.
Figure 3B:
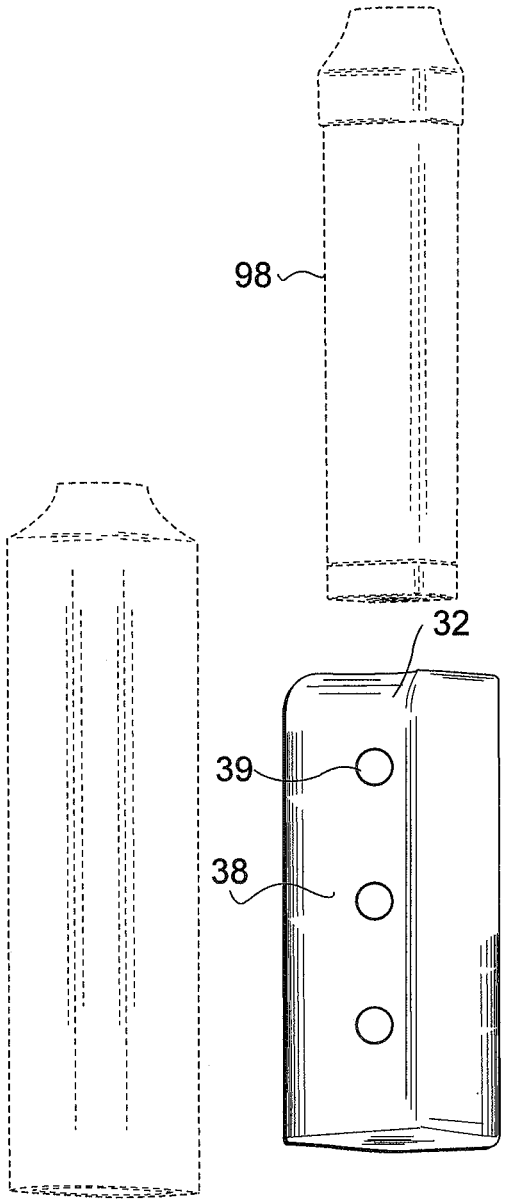
FIG. 3B is a first exploded view thereof from a frontal vantage point.
Figure 3C:
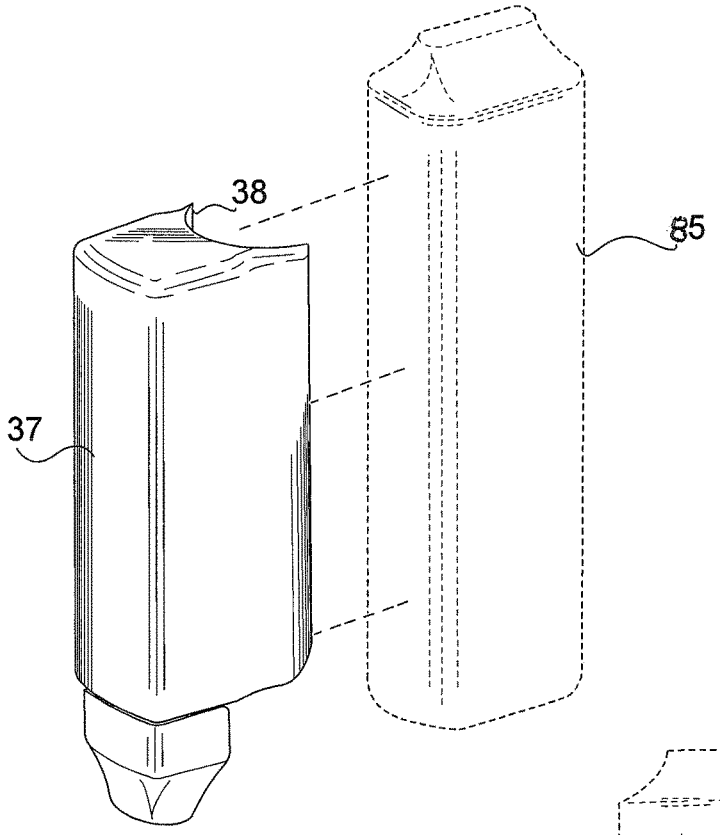
FIG. 3C is a second exploded view thereof from a rear vantage point.
Figure 3D:
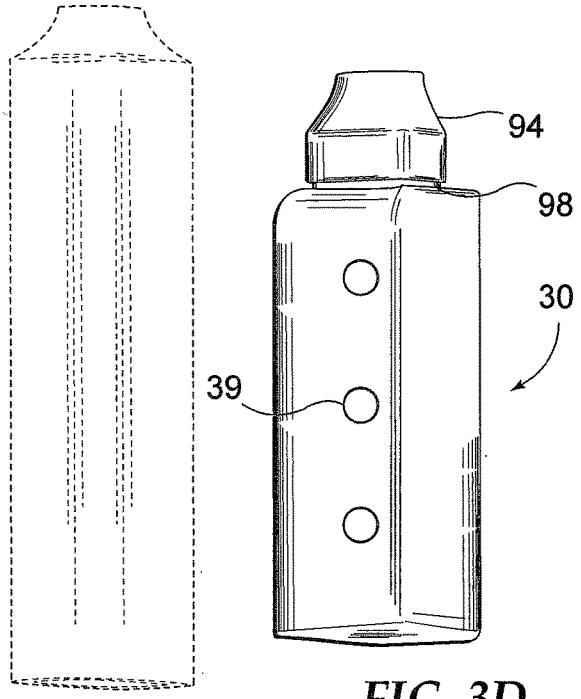
FIG. 3D is yet a third exploded view of the sleeve embodiment containing magnets.

In a similar aspect with regard to FIG. 3A through 3.D, the invention may be characterized as an accessory sleeve 30 for an exhale filter 98 comprising: a first lengthwise channel between wall 37 and surface 38 (similar to embodiments 10, 20, second lengthwise channel 12, 22) parallel to a longitudinal axis of the sleeve, for receiving an exhale filter device 98; and a first magnet 39 coupled at a lateral side 38 of the sleeve 30 for coupling to a side of the vaporizer 85.

In another aspect and with regard to FIG. 4A through FIG. 4C, the invention may be characterized as an accessory sleeve 40 for an exhale filter comprising: a first lengthwise channel 42 (parallel to a longitudinal axis of the sleeve) for receiving the exhale filter 98; and an eyelet 44 coupled to the sleeve 40 at an end thereof, for connecting to a lanyard 93, or a key chain, or a clip, as preferred by a user.

While the particular Accessory E-Cigarette And Filter Assembly herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. An accessory sleeve, electronic cigarette, and exhale filter assembly comprising:

an accessory sleeve;

an electronic cigarette having a proximal end portion and a distal end portion; and an exhale filter having a proximal end portion and a distal end portion, the accessory sleeve comprising:

a first aperture forming a first lengthwise channel extending the entire length of the of the accessory sleeve, said first aperture centered about a first longitudinal axis positioned lengthwise along the accessory sleeve for receiving and holding the electronic cigarette at the electronic cigarette proximal end portion;

a second aperture centered about the first longitudinal axis for receiving and holding the electronic cigarette at the electronic cigarette distal end portion; and a third aperture forming a second lengthwise channel extending the entire length of the of the accessory sleeve, said third aperture centered about a second longitudinal axis positioned lengthwise along the accessory sleeve, wherein the second longitudinal axis is positioned parallel to the first longitudinal axis, wherein the third aperture is for receiving and holding the exhale filter at the exhale filter proximal end portion, and wherein the electronic cigarette is thereby mated and secured juxtaposed to the exhale filter via the accessory sleeve.

2. The accessory sleeve, electronic cigarette, and exhale filter assembly of claim 1, further comprising:

a fourth aperture centered about the second longitudinal axis for receiving and holding the exhale filter at the exhale filter distal end portion, and wherein the first and second lengthwise channels are configured to friction fit said electronic cigarette and said exhale filter.

3. The accessory sleeve, electronic cigarette, and exhale filter assembly of claim 2, further comprising:

a top end wall; and a bottom end wall opposite the top end wall, the first lengthwise channel further comprising a race track configuration through the top end wall and the bottom end wall, the race track configuration comprising a rectangle with rounded ends.

4. The accessory sleeve, electronic cigarette, and exhale filter assembly of claim 3, the electronic cigarette comprising a cylindrical surface, and further wherein the race track configuration comprises a rounded carve out in each of two opposing sides for contacting the electronic cigarette cylindrical surface.

5. The accessory sleeve, electronic cigarette, and exhale filter assembly of claim 2, further comprising an interior wall separating the first and second lengthwise channels.

6. The accessory sleeve, electronic cigarette, and exhale filter assembly of claim 2, the first and second lengthwise channels each comprising a carve out exposing an interior of the accessory sleeve, the carve out for assisting a user in receiving and removing the electronic cigarette and the exhale filter to and from the accessory sleeve e-cigarette and filter assembly.

7. The accessory sleeve, electronic cigarette, and exhale filter assembly of claim 1, further comprising soft silicon rubber for providing impact protection to the electronic cigarette and the exhale filter.

8. The accessory sleeve, electronic cigarette, and exhale filter assembly of claim 1, wherein the exhale filter comprises a mouthpiece, and further wherein the exhale filter mouthpiece rests upon a top end wall of the accessory sleeve.

9. An accessory sleeve, electronic cigarette, and exhale filter assembly comprising:

an accessory sleeve;

an electronic cigarette having a proximal end portion and a distal end portion; and an exhale filter having a proximal end portion and a distal end portion, the accessory sleeve comprising:

a first aperture forming a first lengthwise channel extending an entire length of the accessory sleeve, said first aperture centered about a first longitudinal axis positioned lengthwise along the accessory sleeve for receiving and holding the electronic cigarette at the electronic cigarette proximal end portion;

a second aperture centered about the first longitudinal axis for receiving and holding the electronic cigarette at the electronic cigarette proximal end portion;

a third aperture forming a second lengthwise channel extending an entire length of the accessory sleeve, said third aperture centered about a second longitudinal axis positioned lengthwise along the accessory sleeve, wherein the second longitudinal axis is positioned parallel to the first longitudinal axis, and wherein the third aperture is for receiving and holding the exhale filter at the exhale filter proximal end portion;

a top end wall having the first aperture and the third therethrough;

a bottom end wall opposite the top end wall, wherein the exhale filter distal end portion rests upon the bottom end wall, wherein the electronic cigarette is thereby mated and secured juxtaposed to the exhale filter via the accessory sleeve.

* * * * *